United States Patent [19]

Berendt et al.

[11] Patent Number: 5,009,668

[45] Date of Patent: Apr. 23, 1991

[54] MIXTURE OF ASSISTANTS AND ITS USE IN THE DYEING OF SYNTHETIC FIBRE MATERIALS: ACID ESTER OF OXYALKYLATED PHENDL, NONIONIC SURFACTANT AND DYE CARRIER

[75] Inventors: Hans-Ulrich Berendt, Allschwil; Rosemarie Töpfl, Dornach, both of Switzerland

[73] Assignee: Ciba-Geigy Corporation, Ardsley, N.Y.

[21] Appl. No.: 476,997

[22] Filed: Feb. 8, 1990

[30] Foreign Application Priority Data

Feb. 8, 1989 [CH] Switzerland ..... 430/89

[51] Int. Cl.[5] ..... D06P 1/61; D06P 3/54

[52] U.S. Cl. ..... 8/557; 8/583; 8/589; 8/594; 8/609; 8/610; 8/922; 252/8.6; 252/8.7; 252/8.9; 252/358

[58] Field of Search ..... 8/557, 589, 594; 252/8.7, 8.9

[56] References Cited

U.S. PATENT DOCUMENTS

| | | | |
|---|---|---|---|
| 3,728,078 | 4/1973 | Freshwater et al. | 8/617 |
| 4,252,534 | 2/1981 | Abel et al. | 8/617 |
| 4,894,183 | 1/1990 | Topfl et al. | 252/358 |

*Primary Examiner*—A. Lionel Clingman

*Attorney, Agent, or Firm*—George R. Dohmann; Edward McC. Roberts

[57] ABSTRACT

Mixture of dyeing assistants containing (A) an acid ester, or salts thereof, of an alkylene oxide adduct of the formula

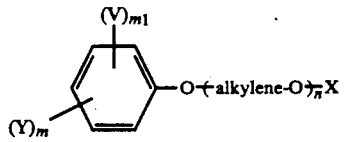

(1)

in which V is hydrogen or methyl, X is the acid radical of an inorganic acid containing oxygen, or the radical of an organic acid and Y is $C_1$–$C_{12}$alkyl, aryl or aralkyl, "alkylene" is the ethylene or propylene radical and m is 1 to 3, $m_1$ is 1 or 2 and n is 4 to 50, (B) a nonionic surfactant containing polyglycol ether groups, and (C) an aliphatic or aromatic carboxylic acid ester, an alkylbenzene, tetralin or a mixture of these substances.

The mixture of assistants is employed in the dyeing of synthetic fibre materials, in particular textile material containing polyester fibres, for increasing the rate of migration of disperse dyes.

19 Claims, No Drawings

MIXTURE OF ASSISTANTS AND ITS USE IN THE DYEING OF SYNTHETIC FIBRE MATERIALS: ACID ESTER OF OXYALKYLATED PHENDL, NONIONIC SURFACTANT AND DYE CARRIER

The present invention relates to a novel combination of assistants and to its use as a dyeing assistant in the dyeing of synthetic fibers, in particular polyester fibers.

The novel dyeing assistant not only effects penetration of the dye into the material, but it also serves to promote the migration of the dyes, in the course of which an improvement in levelness and an increase in the color yield are obtained.

The combination of assistants according to the invention comprises (A) an acid ester, or salts thereof, of an alkylene oxide adduct of the formula

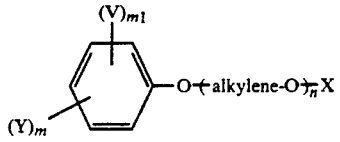

(1)

in which V is hydrogen or methyl, X is the acid radical of an inorganic acid containing oxygen, for example sulfuric acid or phosphoric acid, or the radical of an organic acid and Y is $C_1$–$C_{12}$alkyl, aryl or aralkyl, "alkylene" is the ethylene or propylene radical and m is 1 to 3, $m_1$ is 1 or 2 and n is 4 to 50, (B) a nonionic surfactant, preferably containing polyglycol ether groups, and (C) an aliphatic or aromatic carboxylic acid ester, an alkylbenzene, tetralin or a mixture of these substances.

It is advantageous for the dyeing assistant according to the invention to contain 10 to 50 per cent by weight of component (A), 10 to 40 per cent by weight of component (B) and 10 to 70 per cent by weight of component (C). Not only component (C), but both component (A) and component (B) can be present in the form of a single compound or in the form of a mixture.

If the substituent Y in the formula (1) is an alkyl group, it can be linear or branched. Examples of such alkyl radicals are methyl, ethyl, n-propyl, isopropyl, n-butyl, isobutyl, sec-butyl, tert-butyl, n-pentyl, isopentyl, tert-pentyl, n-hexyl, 2-ethylhexyl, n-heptyl, n-octyl, isooctyl, n-nonyl, isononyl or n-dodecyl.

"Aryl" is preferably phenyl. The phenyl radical can be monosubstituted or disubstituted by halogen, lower alkyl or lower alkoxy.

In the definition of the radicals in the compounds of the formula (1), lower alkyl and lower alkoxy are groups or constituents of groups containing 1 to 5, in particular 1 to 3, carbon atoms. Examples of groups of this type are methyl, ethyl, n-propyl, isopropyl, n-butyl, isobutyl, sec-butyl, tert-butyl, amyl, isoamyl or tert-amyl and methoxy, ethoxy, isopropoxy, isobutoxy or tert-butoxy, respectively.

Examples of halogen are fluorine, bromine or, preferably, chlorine.

Aralkyl advantageously contains 7 to 9 carbon atoms and is, as a rule, benzyl, α-methylbenzyl, α,α-dimethylbenzyl, β-phenethyl, α-tolylethyl or phenisopropyl.

The substituent Y is preferably $C_4$–$C_{10}$alkyl or especially α-methylbenzyl.

$(Alkylene\text{-}O)_n$-chains are preferably of the ethylene glycol, propylene/ethylene glycol or ethylene/propylene glycol type; the former is particularly preferred.

n is preferably 4 to 40.

The acid radical X is derived, for example, from low-molecular dicarboxylic acids, for example maleic acid, succinic acid or sulfosuccinic acid, and is attached to the alkyleneoxy moiety of the molecule via an ester bridge. In particular, however, X is derived from inorganic, polybasic acids, such as sulfuric acid or orthophosphoric acid.

The acid radical X can be in the form of the free acid or a salt, i.e. for example, an alkali metal salt, ammonium salt or amine salt. Examples of such salts are lithium, sodium, potassium, ammonium, trimethylamine, diethylamine, ethanolamine, diethanolamine or triethanolamine salts. Alkali metal salts or triethanolamine salts are preferred. The monoethanolamine or diethanolamine salts can be etherified further with 1 to 4 oxethylene units.

Preferred acid radicals of the component (A) have the formula

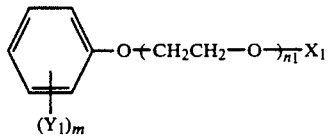

(2)

in which $Y_1$ is $C_4$–$C_{12}$alkyl, phenyl, tolyl, or preferably tolyl-$C_1$–$C_3$alkyl or phenyl-$C_1$–$C_3$-alkyl, for example α-methylbenzyl or α,α-dimethylbenzyl, $X_1$ is an acid radical derived from sulfuric acid or, preferably, o-phosphoric acid and m is 1 to 3 and $n_1$ is 4 to 40.

These acid esters are preferably in the form of sodium, potassium, ammonium, diethylamine, triethylamine, diethanolamine or triethanolamine salts. The acid esters of the formula (1) or (2) which are suitable as component (A) are prepared by adding an alkylene oxide (ethylene oxide or propylene oxide) onto a phenol compound substituted in the manner defined, and converting the adduct by means of a polybasic oxygen acid or a functional derivative of this acid, for example acid anhydrides, acid halides, acid esters or acid amides, into the acid esters and, if appropriate, converting the acid ester obtained into the abovementioned salts. Examples of these functional derivatives which may be mentioned are phosphorus pentoxide, phosphorus oxytrichloride, chlorosulfonic acid or sulfamic acid. Both the alkylene oxide addition and the esterification can be carried out by known methods.

Components (A) which are very suitable are acid esters, or salts thereof, of a polyadduct of 4 to 40 moles of ethylene oxide onto 1 mole of a phenol containing at least one $C_4$–$C_{12}$alkyl group, a phenyl group, a tolyl group, an α-tolylethyl group, a benzyl group, an α-methylbenzyl group or an α,α-dimethylbenzyl group, for example butylphenol, tributylphenol, octylphenol, nonylphenol, dinonylphenol, o-phenylphenol, benzylphenol, dibenzylphenol, α-tolylethylphenol, dibenzyl-(nonyl)-phenol, α-methylbenzylphenol, bis-(α-methylbenzyl)-phenol or tris-(α-methylbenzyl)-phenol, it being possible to use these acid esters on their own or as a mixture.

Esters of particular interest are acid phosphoric acid esters or sulfuric acid esters of adducts of 8 to 30 moles of ethylene oxide onto 1 mole of 4-nonylphenol or, especially, onto 1 mole of compounds prepared by adding 1 to 3 moles of styrenes onto 1 mole of phenols, the phosphoric acid esters preferably being present as mixtures of the corresponding salts of a monoester and a diester.

The preparation of the styrene adducts is effected in a known manner, preferably in the presence of catalysts, such as sulfuric acid or p-toluenesulfonic acid. Suitable styrenes are preferably styrene, α-methylstyrene or vinyltoluene (4-methylstyrene). Examples of the phenols are phenol, cresols or xylenols.

Acid phosphoric acid esters (monoesters and diesters) or sulfuric acid esters, or salts thereof, of alkoxylation products of the formula

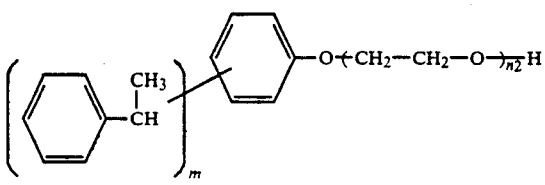

(3)

in which m is 1 to 3 and $n_2$ is 12 to 30 are very particularly preferred.

The following may be mentioned individually as examples of alkoxylation products of the formulae (2) and (3):

An alkoxylation product having 18 ethylene oxide units of the adduct of 2 moles of styrene onto 1 mole of phenol, an alkoxylation product having 18 ethylene oxide units of the adduct of 3 moles of styrene onto 1 mole of phenol, an alkoxylation product having 27 ethylene oxide units of the adduct of 2 moles of 4-methylstyrene onto 1 mole of phenol, an alkoxylation product having 17 ethylene oxide units of the adduct of 3 moles of 4-methylstyrene onto 1 mole of phenol, an alkoxylation product having 18 ethylene oxide units of the mixture of an adduct of 2 moles of styrene onto 1 mole of phenol and an adduct of 3 moles of styrene onto 1 mole of phenol, and an alkoxylation product having 13 ethylene oxide units of the mixture of an adduct of 2 moles of styrene onto 1 mole of phenol and an adduct of 3 moles of styrene onto 1 mole of phenol.

The nonionic surfactant used as component (B) is advantageously an alkylene oxide adduct of 2 to 100 moles of alkylene oxide, for example ethylene oxide and/or propylene oxide, onto 1 mole of an aliphatic monoalcohol having at least 4 carbon atoms, of a trihydric to hexahydric aliphatic alcohol preferably having 3 to 6 carbon atoms, of a phenol which is unsubstituted or substituted by $C_4$–$C_{12}$alkyl, phenyl, α-tolyethyl, benzyl, α-methylbenzyl or α,α-dimethylbenzyl, or of a fatty acid having 8 to 22 carbon atoms.

The following examples of nonionic surfactants may be mentioned:

Adducts of, preferably, 2 to 80 moles of alkylene oxide, in particular ethylene oxide, it being possible for individual ethylene oxide units to be replaced by substituted epoxides, such as styrene oxide and/or propylene oxide, onto higher unsaturated or saturated monoalcohols, fatty acids, fatty amines or fatty amides having in each case 8 to 22 carbon atoms, or onto benzyl alcohols, phenylphenols, benzylphenols, β-phenethylphenols, α-methylbenzyphenols, α,α-dimethylbenzylphenols, α-tolylethylphenols or alkylphenols in which the alkyl radicals contain at least 4 carbon atoms;

alkylene oxide, in particular ethylene oxide and/or propylene oxide, condensation products (block polymers);

ethylene oxide/propylene oxide adducts onto fatty amines or diamines, in particular ethylenediamine;

reaction products formed from a fatty acid containing 8 to 22 carbon atoms and a primary or secondary amine containing at least one hydroxy-lower alkyl or lower alkoxy-lower alkyl group, or alkylene oxide adducts of these reaction products containing hydroxyalkyl groups, the reaction being carried out in such a way that the molecular ratio between hydroxyalkylamine and fatty acid can be 1:1 and greater than 1, for example 1:1 to 2:1, and sorbitan esters, preferably having $C_6$–$C_{24}$fatty acid ester groups, or polyethoxylated sorbitan esters, for example polyoxethylene-sorbitan monolaurate or monooleate or monostearate having in each case 4 to 20 ethylene oxide units or polyoxethylene-sorbitan trioleate having 4 to 20 ethylene oxide units.

Adducts of propylene oxide onto a trihydric to hexahydric aliphatic alcohol having 3 to 6 carbon atoms, for example glycerol or pentaerythritol, the polypropyleneoxy adducts having an average molecular weight of 250 to 1800, preferably 400 to 900; and fatty alcohol polyglycol mixed ethers, in particular adducts of 3 to 30 moles of ethylene oxide and 3 to 30 moles of propylene oxide onto aliphatic monoalcohols having 8 to 22 carbon atoms, preferably alkanols having 8 to 16 carbon atoms.

Of these, the abovementioned alkoxylation products of the formula (3) derived from styrene adducts are particularly preferred as nonionic surfactants.

Other nonionic surfactants which are particularly preferred can be represented by the formula $$R—O—(\text{alkylene}—O)_n—CO—W \quad (4)$$

or by the formula

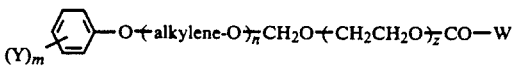

(5)

in which R is an alkyl or alkenyl radical having in each case 8 to 24 carbon atoms or a radical of the formula

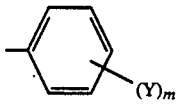

4(a)

W is an aliphatic radical having 8 to 30 carbon atoms and z is 1 to 25 and Y,m,n and "alkylene" are as defined above.

The compounds of the formula (4) can be prepared by reacting the adduct of the formula R—O—(alkylene—O—)$_n$—H with a fatty acid W—COOH or by reacting an alcoholic or phenolic compound R-OH with a fatty acid ester of the formula W—CO—O—(alkylene—O)$_n$—H.

The compounds of the formula (5) are reaction products formed from adducts of the formula

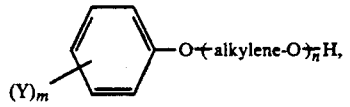

formaldehyde or a formaldehyde donor, for example paraformaldehyde, and a fatty acid ester of the formula $W—CO—O—(CH_2CH_2O)_z—H$, and some are described in Japanese Preliminary Published Specification JP-A 83,18486. Compounds which fall under formula (5) and are not mentioned there can be prepared correspondingly, the reaction conditions mentioned in the Japanese Preliminary Published Specification resulting in the desired products of the formula (5).

Components (B) which are very suitable also have the formula $$R_1—O(CH_2CH_2O)_{m'}—\underset{Z_1}{CH}—\underset{Z_2}{CH}—OH \quad (6)$$

in which $R_1$ is alkyl or alkenyl having in each case 8 to 22 carbon atoms, one of $Z_1$ and $Z_2$ is phenyl and the other is hydrogen and m' is 4 to 80.

The compounds of the formula (6) are prepared by adding styrene oxide onto the polyethylene glycol ether of the formula $R_1—O—(CH_2CH_2O)_{m'}—H$.

The aliphatic or aromatic carboxylic acid esters used as component (C) can be monocarboxylic or dicarboxylic acid diesters prepared by esterifying aliphatic or aromatic monocarboxylic or dicarboxylic acids having 3 to 12 carbon atoms with aliphatic monoalcohols having 4 to 22 carbon atoms or with araliphatic alcohols, in particular benzyl alcohol.

Esters of primary interest are $C_1$–$C_{12}$alkyl esters of propionic acid, lactic acid, butyric acid, hydroxybutyric acid, valeric acid, caproic acid, 2-ethylhexanoic acid, malonic acid, maleic acid, adipic acid, benzoic acid, 2-hydroxybenzoic acid, 4-hydroxybenzoic acid or phthalic acid and, in particular, $C_8$–$C_{12}$alkyl benzoates or especially aralkyl benzoates. The following may be mentioned individually as examples of a component (C) of this type: 2-ethylhexyl propionate, n-octyl lactate, 2-ethylhexyl lactate, 2-ethylhexyl 2-ethylhexanoate, di-2-ethylhexyl maleate, di-2-ethylhexyl adipate, methyl benzoate, butyl benzoate, 2-ethylhexyl benzoate, decyl benzoate, dodecyl benzoate, phenyl benzoate, 2-methylphenyl benzoate, benzyl benzoate, phenoxyethyl benzoate or dimethyl phthalate. Benzyl benzoate is particularly preferred as the component (C).

Examples of the alkylbenzenes to be employed as component (C) are mixtures of alkylated benzenes formed by the catalytic reduction of petroleum fractions. These are, in particular, benzene derivatives containing one or more methyl and/or ethyl groups. They are, in particular, toluene, xylene, trimethylbenzene, tetramethylbenzene, methylethylbenzene, dimethylethylbenzene, trimethylethylbenzene, ethylbenzene or 4-isopropyltoluene or mixtures thereof. Particularly satisfactory results are obtained using mixtures of methylethylbenzene and trimethylbenzene or of dimethylethylbenzene, tetramethylbenzene and trimethylethylbenzene. Mixtures of an alkylbenzene and tetralin can also be used as the component (C).

The dyeing assistants according to the invention can additionally contain water and/or organic solvents miscible with water as a component (D) in the form of a polar solvent. An additive of this type serves the purpose of improving the homogeneity of the preparation. Examples of water-miscible organic solvents are aliphatic $C_1$–$C_4$alcohols, for example methanol, ethanol or the propanols; ketones, for example acetone, methyl ethyl ketone, cyclohexanone or diacetone alcohol; ethers, for example diisopropyl ether, dioxane or tetrahydrofuran; ethylene glycol, propylene glycol, monoalkyl ethers of glycols, for example ethylene glycol monomethyl, monoethyl and monobutyl ether and diethylene glycol monomethyl or monoethyl ether, and also tetrahydrofurfuryl alcohol, pyridine, acetonitrile, γ-butyrolactone, N,N-dimethylformamide, N,N-dimethylacetamide, tetramethylurea or tetramethylene sulfone. Mixtures of the said solvents can also be used.

The mixtures of assistants according to the invention advantageously contain, in each case relative to the total mixture, 10 to 40 per cent by weight of the component (A)
15 to 50 per cent by weight of the component (B)
20 to 70 per cent by weight of the component (C)
0 to 40 per cent by weight of the component (D).

The novel preparations of dyeing assistants can be prepared merely by stirring together the said components (A), (B), (C) and, if appropriate, (D), homogeneous mixtures being obtained which are distinguished by good stability on transport and storage. The dyeing assistants according to the invention are, in particular, very stable at elevated temperatures of up to 130° C., when they are employed in dyebaths.

The dyeing assistant according to the invention is used, in each case depending on the dyestuff, in the dyeing of textile material containing synthetic fibers, in particular polyester fibers. The dyeing process is carried out in each case in a customary manner. The dyeing assistant according to the invention is introduced slowly and with stirring into an aqueous liquor, after which the liquor is prepared for dyeing by adding the dye.

Accordingly, the present invention also relates to a process for dyeing synthetic material, in particular polyester fibers, by means of disperse dyes. The process comprises dyeing this material in the presence of the mixture of assistants according to the invention.

The amounts in which the combination of assistants according to the invention is added to the dyebaths range from 0.5 to 10%, preferably 1 to 5%, of the weight of the goods.

Examples which may be mentioned of fiber material, in particular textile material, which can be dyed in the presence of the novel mixture of assistants are cellulose ester fibers, such as cellulose acetate and triacetate fibers and, in particular, linear polyester fibers.

Linear polyester fibers are to be understood here as meaning synthetic fibers which are obtained, for example, by the condensation of terephthalic acid with ethylene glycol or of isophthalic acid or terephathalic acid with 1,4-bis-(hydroxymethyl)-cyclohexane, and also copolymers formed from terephthalic and isophthalic acid and ethylene glycol. The linear polyester which has hitherto been employed almost exclusively in the textile industry consists of terephthalic acid and ethylene glycol.

The fiber materials can also be used in the form of mixed fabrics, with each other or with other fibers, for example mixtures of polyacrylonitrile/polyester, polyamide/polyester, polyester/cotton, polyester/viscose and polyester/wool.

The textile material to be dyed can be in various stages of processing. For example, the following are suitable: loose material, piece goods, such as knitted or woven fabrics, and yarn in package or muff form. The latter can have a package density of 200 to 600 g/dm$^3$, in particular 400 to 450 g/dm$^3$.

The disperse dyes to be used, which are only very slightly soluble in water and are present in the dye liquor for the most part in the form of a fine dispersion, can belong to a very wide range of classes of dye, for example the acridone, azo, anthraquinone, coumarin, methine, perinone, naphthoquinoneimine, quinophthalone, styryl or nitro dyes.

The amount of dyes to be added to the liquor depends on the tinctorial strength desired; in general, amounts of 0.01 to 10, preferably 0.05 to 5, per cent by weight, relative to the textile material employed, have proved successful.

Depending on the textile material to be treated, the dyebaths can contain, in addition to the dyes and the mixture of assistants according to the invention, oligomeric inhibitors, anti-foaming agents (for example silicone oils or ethylene-bis-fatty acid amides), non-creasing agents and, preferably, dispersants.

The dispersants serve, in particular, to achieve good dispersion of the disperse dyes. The dispersants which are generally customary in dyeing by means of disperse dyes are suitable.

Suitable dispersants are preferably sulfated or phosphated adducts of 15 to 100 moles of ethylene oxide or, preferably, propylene oxide onto polyhydric aliphatic alcohols having 2 to 6 carbon atoms, for example ethylene glycol, glycerol or pentaerythritol or onto amines having 2 to 9 carbon atoms and containing at least two amino groups or one amino group and one hydroxyl group, and also alkylsulfonates having 10 to 20 carbon atoms in the alkyl chain, alkylbenzenesulfonates having a linear or branched alkyl chain with 8 to 20 carbon atoms in the alkyl chain, for example nonylbenzesulfonate, dodecylbenzenesulfonate, 1,3,5,7-tetramethyloctylbenzenesulfonate or octadecylbenzenesulfonate, and also alkylnaphthalenesulfonates or sulfosuccinic acid esters, for example sodium dioctylsulfosuccinate or sodium di-2-ethylhexylsulfosuccinate.

Ligninsulfonates, polyphosphates and, preferably, formaldehyde condensation products formed from aromatic sulfonic acids, formaldehyde and phenols which can be monofunctional or bifunctional, for example from cresol, $\beta$-naphtholsulfonic acid and formaldehyde, from benzenesulfonic acid, formaldehyde and naphthalenesulfonic acid, from naphthalenesulfonic acid and formaldehyde or from naphthalenesulfonic acid, dihydroxydiphenyl sulfone and formaldehyde, have proved particularly advantageous as anionic dispersing agents. The disodium salt of di-(6-sulfonaphth-2-yl)-methane or tri-(6-sulfonaphth-2-yl)-methane is preferred.

It is also possible to use mixtures of anionic dispersants. Normally, the anionic dispersants are present in the form of their alkali metal salts, ammonium salts or amine salts. These dispersants are preferably used in an amount of 0.5 to 8 g/l of liquor.

The dyebaths can also contain customary additives, preferably electrolytes, such as salts, for example sodium sulfate, ammonium sulfate, sodium or ammonium phosphates, sodium or ammonium polyphosphates, metal chlorides or nitrates, such as calcium chloride, magnesium chloride or calcium nitrates, ammonium acetate or sodium acetate and/or acids, for example mineral acids, such as sulfuric acid or phosphoric acid, or organic acids, preferably lower aliphatic carboxylic acids, such as formic acid,acetic acid, citric acid or oxalic acid. The acids serve, in particular, to adjust the pH of the liquors used in accordance with the invention, which, as a rule, is 4 to 6.5, preferably 4.5 to 6. In certain cases, however, it is also possible to carry out dyeing in an alkaline range (pH 7 to 10).

Dyeing is advantageously carried out from an aqueous liquor by the exhaustion process. The liquor ratio can, accordingly, be selected within a wide range, for example 3:1 to 100:1, preferably 7:1 to 50:1. The temperature at which dyeing is carried out is at least 70° C. and, as a rule, is not higher than 140° C. It is preferably within the range from 80° to 135° C.

Linear polyester fibers and cellulose triacetate fibers are preferably dyed by the so-called high-temperature process in closed, and preferably also pressure-resistant, equipment at temperatures of over 100° C., preferably between 110° and 135° C., and, if appropriate, under pressure. Examples of suitable closed vessels are circulation machines, such as package or beam dyeing machines, winch becks, nozzle or drum dyeing machines, jet or muff dyeing machines, paddle machines or jiggers.

Cellulose acetate fibers are preferably dyed at temperatures of 80°-85° C.

The dyeing process can be carried out in such a way that the material to be dyed is either first treated briefly with the mixture of assistants and is then dyed or, preferably, is treated simultaneously with the mixture of assistants and the dye.

It is preferable to allow the material to be dyed a preliminary run of 5-10 minutes at 40°-80° C. in the bath which contains the dye, the mixture of assistants and, if appropriate, further additives and whose pH has been adjusted to a value of 4.5 to 10, to raise the temperature in the course of 15 to 45 minutes to 110° to 135° C., preferably 125°-130° C., and to keep the dye liquor for 15 to 90 minutes, preferably 30 to 60 minutes, at this temperature.

The dyeings are finished by cooling the dye liquor to 60° to 90° C., rinsing the dyeings with water and, if appropriate, reduction clearing them in a customary manner in an alkaline medium under reductive conditions. The dyeings are then rinsed again and dried. Uniform and intense dyeings which are additionally distinguished by good fastness to light and good fastness properties to rubbing are obtained on synthetic fiber material, in particular on linear polyester fibers. The dye liquor remains stable during the dyeing and no deposits are formed in the interior of the dyeing machines.

In the following preparation methods and use examples, parts are parts by weight and percentages are percentages by weight.

PREPARATION METHODS

Method 1

229 g of tristyrylphenol polyethylene glycol ether having 11 oxyethylene units are subjected to condensation with 92.5 g of diethylene glycol oleate, 8.7 g of paraformaldehyde and 2.3 g of 37% hydrochloric acid for 7 hours at 120°-130° C. In the course of this, the water formed is removed from the reaction mixture via a descending condenser. A brown, viscous product corresponding to the formula

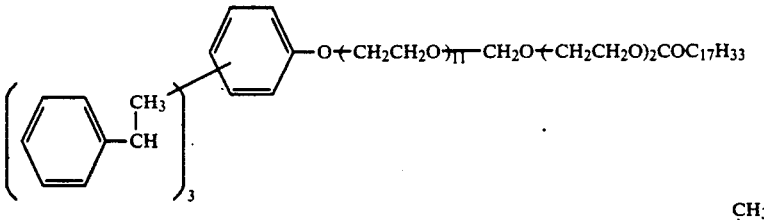

(11)

is obtained and is employed as such as component (B).

Method 2

164.7 g of the adduct of 20 moles of ethylene oxide onto 1 mole of p-nonylphenol are heated slowly to 120°-130° C. in a nitrogen atmosphere together with 45.75 g of coconut oil fatty acid diethylene glycol ester, 5.2 g of paraformaldehyde and 1.4 g of 37% hydrochloric acid. In the course of this, the water formed is removed via a descending condenser for 24 hours. A brown viscous product corresponding to the formula

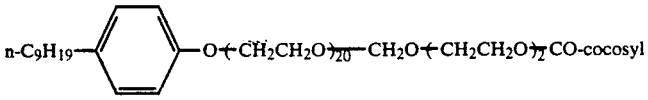

(12)

is obtained and is employed as such as component (B).

The compounds of the formula

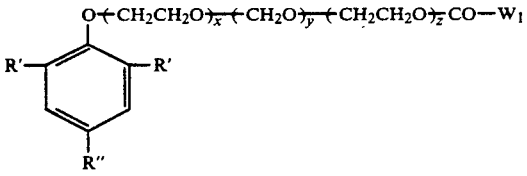

(13)

are prepared in a manner similar to that described in methods 1 and 2, using the appropriate starting materials.

| Method | R' | R'' | x | y | z | $W_1$ |
|---|---|---|---|---|---|---|
| 3 | 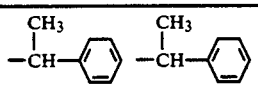 |  | 22 | 1 | 2 | $-C_{17}H_{33}$ |
| 4 | 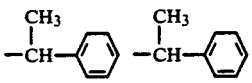 |  | 25 | 1 | 2 | $-C_{17}H_{33}$ |
| 5 | 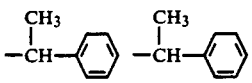 |  | 16 | 1 | 2 | -lanolin |
| 6 | 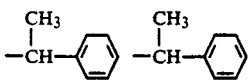 |  | 18 | 1 | 2 | $-C_{17}H_{33}$ |
| 7 | 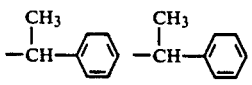 |  | 16 | 1 | 2 | $-C_{17}H_{33}$ |
| 8 | | | 40 | 1 | 2 | $-C_{17}H_{33}$ |
| 9 | 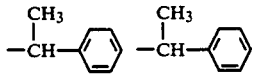 | H | 5 | 1 | 2 | -cocosyl |

Method 10

75 g of 2,6-distyryl-4-nonylphenol are stirred for 6½ hours at 130°-160° C. with 150 g of polyethylene glycol oleate having 13.6 oxyethylene units and 1.5 g of 96% sulfuric acid. The water formed is removed from the reaction mixture via a descending condenser. A brown, viscous product corresponding to the formula

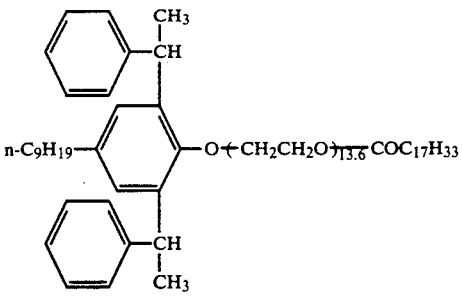

(14)

is obtained and is employed as such as component (B).

Method 11

164.7 g of the adduct of 20 moles of ethylene oxide onto 1 mole of p-nonylphenol are heated at 155°-160° C. in an atmosphere of nitrogen with 32.55 g of coconut oil fatty acid and 0.5 g of p-toluenesulfonic acid. The water formed is removed from the reaction mixture via a descending condenser. The reaction takes 24 hours. A pale brown product corresponding to the formula

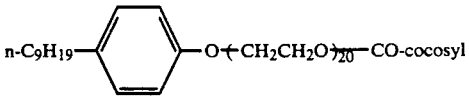

(15)

is obtained and is employed as such as component (B).

The following compounds of the formula

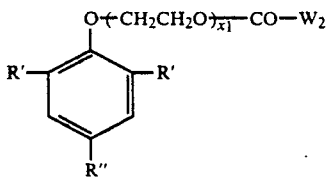

(16)

are prepared in a manner similar to that described in method 10 and 11, using the appropriate starting materials.

| Method | R' | R'' | $x_1$ | $W_2$ |
|---|---|---|---|---|
| 12 | $-CH(CH_3)-C_6H_5$ | $-C(CH_3)_3$ | 22 | $-C_{17}H_{33}$ |
| 13 | $-CH(CH_3)-C_6H_5$ | $-CH(CH_3)-C_6H_5$ | 13.6 | $-C_{17}H_{33}$ |
| 14 | $-CH(CH_3)-C_6H_5$ | $-C(CH_3)_3$ | 9 | $-C_{17}H_{33}$ |
| 15 | $-CH(CH_3)-C_6H_5$ | $-C(CH_3)_3$ | 13.6 | -cocosyl |
| 16 | $-CH(CH_3)-C_6H_5$ | $-C(CH_3)_3$ | 9 | -cocosyl |
| 17 | $-CH(CH_3)-C_6H_5$ | $-CH(CH_3)-C_6H_5$ | 9 | $-C_{17}H_{33}$ |
| 18 | $-CH(CH_3)-C_6H_5$ | $-CH(CH_3)-C_6H_5$ | 22 | $-C_{17}H_{33}$ |
| 19 | $-CH(CH_3)-C_6H_5$ | $-n-C_9H_{19}$ | 22 | $-C_{17}H_{33}$ |
| 20 | H | $-n-C_9H_{19}$ | 35 | -cocosyl |
| 21 | H | $-n-C_9H_{19}$ | 35 | -cocosyl |
| 22 | H | $-n-C_9H_{19}$ | 5 | -cocosyl |
| 23 | H | $-n-C_9H_{19}$ | 7 | -cocosyl |

USE EXAMPLES

Example 1

100 parts of a polyester fabric are put into a bath at 60° C. which contains 1500 parts of water, 2 g/l of ammonium sulfate, 2.5 parts of a dye of the formula

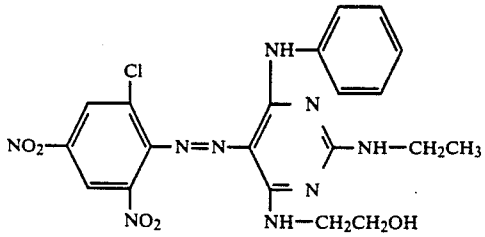

(101)

and 2 parts of an assistant formulation ($P_1$) consisting of 12 parts of the sodium salt of the acid sulfuric acid ester of the alkoxylation product of 18 moles of ethylene oxide added onto 1 mole of the adduct of 3 moles of styrene onto 1 mole of phenol, 12 parts of the alkoxylation product of 18 moles of ethylene oxide added onto 1 mole of the adduct of 3 moles of styrene onto 1 mole of phenol, 16 parts of the adduct of 36 moles of ethylene oxide onto 1 mole of stearyl alcohol and 60 parts of benzyl benzoate, and which has been adjusted to pH 5 with formic acid. The liquor is heated to 130° C. in the course of 30 minutes, with continuous circulation, and dyeing is carried out at this temperature for 60 minutes. The liquor is then cooled and drained off and the goods are rinsed and dried. A level, brilliant red dyeing which is fast to rubbing is obtained with a high colour yield. The usual reduction clearing is not necessary.

Example 2

100 parts of a knitted fabric composed of texturized polyester fibers are introduced into a jet dyeing machine containing 1500 parts of water heated to 60° C., 2 parts of ammonium sulfate, 2.9 parts of the dye of the formula

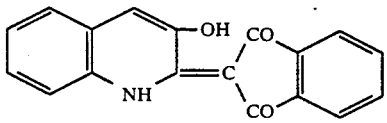

(102)

2.6 parts of the dye of the formula

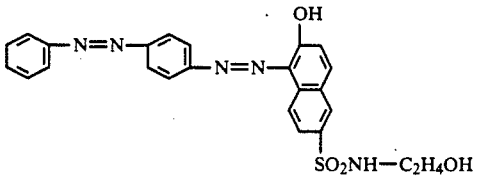

(103)

0.8 part of the dye of the formula

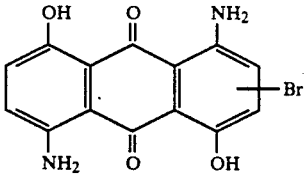

(104)

and 2 parts of an assistant formulation ($P_2$) consisting of 20 parts of the sodium salt of the acid sulfuric acid ester of the alkoxylation product of 18 moles of ethylene oxide added onto 1 mole of the adduct of 3 moles of styrene onto 1 mole of phenol, 20 parts of the alkoxylation product of 18 moles of ethylene oxide added onto 1 mole of the adduct of 3 moles of styrene onto 1 mole of phenol and 60 parts of benzyl benzoate, the pH of the liquor being adjusted to 5 with formic acid. The liquor is then heated to 130° C. in the course of 30 minutes, after which dyeing is carried out at this temperature for 60 minutes. No interfering foam is observed during this time. The liquor is then cooled to 70° C. and the substrate is reduction cleared in the customary manner, rinsed and dried. A level and fast brown dyeing is obtained, with an excellent penetration of the goods by the dye.

Example 3

100 parts of a package composed of texturized polyester yarns are introduced into an HT dyeing machine containing 800 parts of water heated to 40° C., 2 parts of ammonium sulfate, 4 parts of a dye of the formula

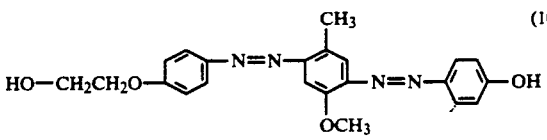

(105)

and 2 parts of an assistant formulation ($P_3$) consisting of 24 parts of the sodium salt of the acid sulfuric acid ester of the adduct of 35 moles of ethylene oxide onto 1 mole of nonylphenol,
16 parts of the adduct of 36 moles of ethylene oxide onto 1 mole of stearyl alcohol and
60 parts of benzyl benzoate, the pH of the liquor being adjusted to 5 with formic acid.

The liquor is then heated to 128° C. in the course of 40 minutes and the goods are dyed for 60 minutes at this temperature. During the heating up phase no increase in the pressure difference between the inside and the outside of the yarn package is recorded. The liquor is then cooled to 70° C. and the substrate is reduction cleared in the usual manner, rinsed, and dried. A deep, level, orange dyeing is obtained which is distinguished by good penetration of the dye and good fastness properties.

If the same amount of the following preparations is used in Example 3 instead of the assistant formulation ($P_3$), a deep and fast orange dyeing is also obtained in each case.

($P_4$) A preparation consisting of 20 parts of the triethanolamine salt of a mixture of the monoester and diester phosphate of an alkoxylation product containing 18 ethylene oxide units of the adduct of 2.5 to 3 moles of styrene onto 1 mole of phenol,
20 parts of an alkoxylation product of 18 moles of ethylene oxide with 1 mole of an adduct of 2.5 to 3 moles of styrene onto 1 mole of phenol and
60 parts of benzyl benzoate.

($P_5$) A preparation consisting of 16 parts of the sodium salt of the acid sulfuric acid ester of the adduct of 35 moles of ethylene oxide onto 1 mole of nonylphenol,
24 parts of the compound of the formula (11) prepared in accordance with method 1 and
60 parts of benzyl benzoate.

($P_6$) A preparation consisting of 16 parts of the sodium salt of the acid sulfuric acid ester of the adduct of 35 moles of ethylene oxide onto 1 mole of nonylphenol,
24 parts of the compound of the formula (15) prepared in accordance with method 11 and
60 parts of benzyl benzoate.

($P_7$) A preparation consisting of 16 parts of the sodium salt of the acid sulfuric acid ester of the adduct of 35 moles of ethylene oxide onto 1 mole of nonylphenol,
24 parts of the adduct of 36 moles of ethylene oxide onto 1 mole of stearyl alcohol and
60 parts of 2-ethylhexyl propionate.

($P_8$) A preparation consisting of 16 parts of the sodium salt of the acid sulfuric acid ester of the adduct of 35 moles of ethylene oxide onto 1 mole of nonylphenol,
24 parts of the adduct of 36 moles of ethylene oxide onto 1 mole of stearyl alcohol and
60 parts of n-octyl lactate.

($P_9$) A preparation consisting of 12 parts of the sodium salt of the acid sulfuric acid ester of the alkoxylation product of 18 moles of ethylene oxide added onto 1 mole of the adduct of 3 moles of styrene onto 1 mole of phenol,
12 parts of the alkoxylation product of 18 moles of ethylene oxide added onto 1 mole of the adduct of 3 moles of styrene onto 1 mole of phenol and
60 parts of dodecyl benzoate.

($P_{10}$) A preparation consisting of 12 parts of the sodium salt of the acid sulfuric acid ester of the alkoxylation product of 18 moles of ethylene oxide added onto 1 mole of the adduct of 3 moles of styrene onto 1 mole of phenol,
12 parts of the alkoxylation product of 18 moles of ethylene oxide added onto 1 mole of the adduct of 3 moles of styrene onto 1 mole of phenol and
60 parts of decyl benzoate.

Example 4

100 parts of a knitted fabric composed of texturized polyester fibers are introduced into an HT dyeing machine containing 1400 parts of water heated to 60° C., 2 parts of ammonium sulfate, 2.5 parts of a dye of the formula

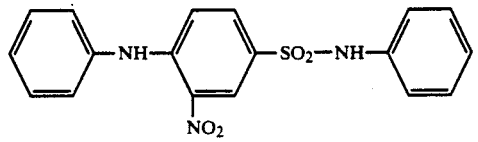

(106)

and 1.5 parts of an assistant formulation ($P_{11}$) consisting of 20 parts of the sodium salt of the acid sulfuric acid ester of the alkoxylation product of 18 moles of ethylene oxide added onto 1 mole of the adduct of 3 moles of styrene onto 1 mole of phenol, 20 parts of the alkoxylation product of 18 moles of ethylene oxide added onto 1 mole of the adduct of 3 moles of styrene onto 1 mole of phenol and 60 parts of tetrahydronaphthalene, the pH of the dye liquor being adjusted to 5 with formic acid.

The liquor is heated to 130° C. in the course of 30 minutes, with continuous circulation, and dyeing is carried out at this temperature for 30 minutes. 0.1 part of the blue dye of the formula (104) is then added, after which dyeing is carried out for 30 minutes at 130° C. The liquor is then cooled and drained off and the goods are rinsed and dried. A level, brilliant, green dyeing which is fast to rubbing is obtained. The customary reduction clearing is not necessary.

If the same amount of a preparation ($P_{12}$) consisting of 20 parts of the triethanolamine salt of a mixture of the monoester and diester phosphate of an alkoxylation product with 18 ethylene oxide units of the adduct of 2.5 to 3 moles of styrene onto 1 mole of phenol, 20 parts of an alkoxylation product of 18 moles of ethylene oxide with 1 mole of an adduct of 2.5 to 3 moles of styrene onto 1 mole of phenol and 60 parts of trimethylbenzene, is used in Example 4 instead of the assistant preparation($P_{11}$), a level, deep, green dyeing is also obtained.

What is claimed is:

1. A mixture of dyeing assistants which comprises (A) an acid ester, or salts thereof, of an alkylene oxide adduct of the formula

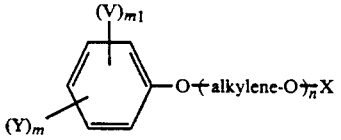

(1)

in which V is hydrogen or methyl, X is the acid radical of an inorganic acid containing oxygen, or the radical of an organic acid and Y is $C_1$–$C_{12}$alkyl, aryl or aralkyl, "alkylene" is the ethylene or propylene radical and m is 1 to 3, $m_1$ is 1 or 2 and n is 4 to 50, (B) a nonionic surfactant containing polyglycol ether groups, and (C) an aliphatic or aromatic carboxylic acid ester, an alkylbenzene, tetralin or a mixture of these substances;

with the proviso that the mixture is substantially free of non-aromatic, water-immiscible solvents.

2. A mixture according to claim 1, wherein Y in formula (1) is $C_4$–$C_{10}$alkyl or α-methylbenzyl.

3. A mixture according to claim 1, wherein the acid radical X in formula (1) is derived from sulfuric acid or orthophosphoric acid.

4. A mixture according to claim 1, wherein n in formula (1) is 4 to 40.

5. A mixture according to claim 1, wherein V in formula (1) is hydrogen.

6. A mixture according to claim 1, wherein the component (A) has the formula

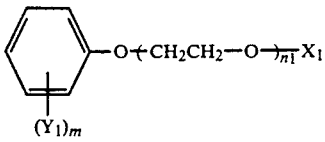

(2)

in which $Y_1$ is $C_4$–$C_{12}$alkyl, phenyl, tolyl, tolyl-$C_1$–$C_3$alkyl or phenyl-$C_1$–$C_3$alkyl, $X_1$ is an acid radical derived from sulfuric acid or orthophosphoric acid and m is 1 to 3 and $n_1$ is 4 to 40.

7. A mixture according to claim 8, wherein the component (A) is an acid phosphoric acid ester or sulfuric acid ester, or salts thereof, of an alkoxylation product of the formula

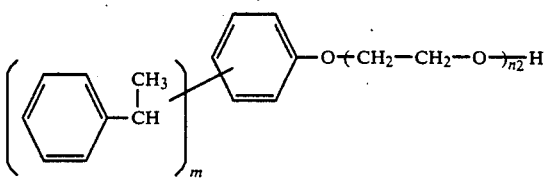

(3)

in which m is 1 to 3 and $n_2$ is 12 to 30.

8. A mixture according to claim 1, wherein the component (A) is an acid phosphoric acid ester or sulfuric acid ester or salts thereof of an alkoxylation product of 8 to 30 moles of ethylene oxide added onto 1 mole of p-nonylphenol or onto 1 mole of a compound which has been prepared by the addition of 1 to 3 moles of styrene, α-methylstyrene or vinyltoluene onto 1 mole of phenol, cresol or xylenol.

9. A mixture according to claim 1, wherein the component (B) is an alkylene oxide adduct of 2 to 100 moles of alkylene oxide onto 1 mole of an aliphatic monoalcohol having at least 4 carbon atoms, of a trihydric to hexahydric aliphatic alcohol having 3 to 6 carbon atoms, of a phenol which is unsubstituted or substituted by $C_1$–$C_4$alkyl, phenyl, α-tolylethyl, benzyl, α-methylbenzyl or α,α-dimethylbenzyl, or of a fatty acid having 8 to 22 carbon atoms.

10. A mixture according to claim 9, wherein the component (B) is an alkoxylation product of the formula

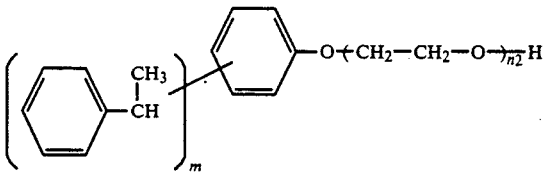

(3)

in which m is 1 to 3 and $n_2$ is 12 to 30.

11. A mixture according to claim 1, wherein the component (B) is a compound of the formula R—O—alkylene—$O_n$CO—W (4)

in which R is an alkyl or alkenyl radical having in each case 8 to 24 carbon atoms or a radical of the formula

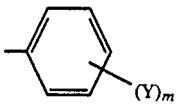

4(a)

and W is an aliphatic radical having 8 to 30 carbon atoms and Y, m, n and "alkylene" are as defined in claim 1.

12. A mixture according to claim 1, wherein the component (B) is a compound of the formula

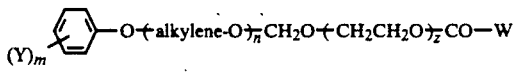

(5)

in which W is an aliphatic radical having 8 to 30 carbon atoms and z is 1 to 25 and Y, m, n and "alkylene" are as defined in claim 1.

13. A mixture according to claim 1, wherein the component (B) is a compound of the formula

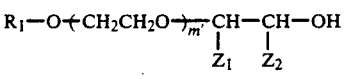

(6)

in which $R_1$ is alkyl or alkenyl having in each case 8 to 22 carbon atoms, one of $Z_1$ and $Z_2$ is phenyl and the other is hydrogen and m' is 4 to 80.

14. A mixture according to claim 1, wherein the component (C) is a monocarboxylic or dicarboxylic acid ester formed from an aliphatic or aromatic monocarboxylic or dicarboxylic acid having 3 to 12 carbon atoms and an aliphatic monoalcohol of 4 to 22 carbon atoms or an araliphatic alcohol.

15. A mixture according to claim 14, wherein the component (C) is benzyl benzoate.

16. A mixture according to claim 14, wherein the component (C) is a $C_8$–$C_{12}$alkyl benzoate.

17. A mixture according to claim 14, which additionally contains a polar solvent as a component (D).

18. A mixture according to claim 17, which comprises, relative to the whole mixture, 10 to 40 per cent by weight of the component (A),
15 to 50 per cent by weight of the component (B)
20 to 70 per cent by weight of the component (C) and
0 to 40 per cent by weight of the component (D).

19. A process for dyeing textile material containing polyester fibers by means of disperse dyes, which comprises dyeing this material in the presence of the mixture of assistants according to claim 1.

* * * * *